US012631073B2

(12) United States Patent
Halmari

(10) Patent No.: US 12,631,073 B2
(45) Date of Patent: May 19, 2026

(54) ALIGNMENT SYSTEM AND METHODOLOGY UTILIZING ROTATING CONTROL DEVICE

(71) Applicant: Schlumberger Technology Corporation, Sugar Land, TX (US)

(72) Inventor: Jaakko Jalmari Halmari, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 37 days.

(21) Appl. No.: 18/428,247

(22) Filed: Jan. 31, 2024

(65) Prior Publication Data

US 2025/0243717 A1 Jul. 31, 2025

(51) Int. Cl.
*E21B 17/10* (2006.01)

(52) U.S. Cl.
CPC ..... *E21B 17/1078* (2013.01)

(58) Field of Classification Search
CPC ..... E21B 33/085; E21B 3/00; E21B 33/03; E21B 33/0355; E21B 33/0387; E21B 34/04; E21B 7/12; E21B 19/002
See application file for complete search history.

(56) References Cited

U.S. PATENT DOCUMENTS 4,273,372 A * 6/1981 Sheshtawy ..... E21B 33/043 166/212
4,388,971 A * 6/1983 Peterson ..... E21B 23/02 166/387
7,258,171 B2 8/2007 Bourgoyne
9,650,852 B2 5/2017 Arnt
10,167,694 B2 1/2019 Le
10,364,625 B2 7/2019 Grace
10,370,923 B2 8/2019 Le
10,408,000 B2 9/2019 Wagoner
10,435,980 B2 10/2019 Grace
10,605,021 B2 3/2020 Le
10,605,038 B2 3/2020 Chau
10,648,262 B2 5/2020 Tran
10,876,368 B2 12/2020 Le
10,995,562 B2 5/2021 Wagoner
11,149,507 B2 10/2021 Tran
11,326,403 B2 5/2022 Wagoner
2012/0000664 A1* 1/2012 Nas ..... E21B 33/0387 166/344

(Continued)

FOREIGN PATENT DOCUMENTS

OA 18268 9/2018
WO 2019168981 A1 9/2019

*Primary Examiner* — Yanick A Akaragwe
(74) *Attorney, Agent, or Firm* — Jeffrey D. Frantz

(57) ABSTRACT

A technique facilitates drilling of a borehole by simplifying alignment between a running tool and a seal rotating system. According to an embodiment, the running tool is connected into a drill string. The drill string is then used to move the running tool linearly within the seal rotating system until engagement of an alignment mechanism occurs. With continued linear movement, the alignment mechanism automatically causes relative rotation between the running tool and the seal rotating system until a desired alignment position is achieved. The seal rotating system may then be secured to the running tool via threaded fasteners or other suitable fastening mechanism.

20 Claims, 5 Drawing Sheets

(56) References Cited

U.S. PATENT DOCUMENTS

| | | | | |
|---|---|---|---|---|
| 2012/0085545 | A1 | 4/2012 | Tarique | |
| 2012/0318496 | A1 | 12/2012 | Bailey | |
| 2013/0175044 | A1 | 7/2013 | Telfer | |
| 2014/0338908 | A1* | 11/2014 | Ervin | E21B 17/042 166/113 |
| 2017/0328145 | A1* | 11/2017 | Wagoner | E21B 19/002 |
| 2021/0131205 | A1 | 5/2021 | Tran | |
| 2021/0301630 | A1* | 9/2021 | Krippner | E21B 33/085 |
| 2022/0205335 | A1 | 6/2022 | Martins et al. | |
| 2022/0364421 | A1 | 11/2022 | Nguyen | |

* cited by examiner

ALIGNMENT SYSTEM AND METHODOLOGY UTILIZING ROTATING CONTROL DEVICE

BACKGROUND

In many oil and gas well applications, a rotating control device is used to contain and isolate pressure in the wellbore annulus while rotary drilling. The rotating control device comprises a housing and an inner seal rotating system of a rotating control device. When used in offshore operations, e.g. subsea drilling, the rotating control device housing may be integral to a riser system extending up through the sea toward a surface facility from a seabed location. The seal rotating system is deployed inside the rotating control device housing and at least portions of the system rotate with the drill string during a drilling operation while maintaining a seal between the drill string and the rotating control device housing. A running tool is used to carry the seal rotating system down through, for example, the riser, until deployed into the rotating control device housing. However, the running tool must be aligned properly within the seal rotating system to enable suitable connection and fastening between the running tool and the seal rotating system. Obtaining the necessary alignment often is difficult and time-consuming.

SUMMARY

In general, a methodology and system facilitate drilling of a borehole by simplifying alignment between a running tool and a seal rotating system. According to an embodiment, the running tool is connected into a drill string. The drill string is then used to move the running tool linearly within the seal rotating system until engagement of an alignment mechanism occurs. With continued linear movement, the alignment mechanism automatically causes relative rotation between the running tool and the seal rotating system until a desired alignment position is achieved. The seal rotating system may then be secured to the running tool via threaded fasteners or other suitable fastening mechanism.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a methodology and system which facilitate drilling of a borehole by simplifying alignment between a running tool and a seal rotating system of a rotating control device. According to an embodiment, the running tool is connected into a drill string and becomes part of the drill string. Once the running tool is positioned within the seal rotating system, linear movement of the drill string may be used to move the running tool linearly until engagement of an alignment mechanism occurs. With continued linear movement, the alignment mechanism automatically causes relative rotation between the running tool and the seal rotating system until a desired alignment position is achieved. The seal rotating system may then be secured to the running tool via threaded fasteners or other suitable fastening mechanism.

Additionally, in some embodiments, the running tool remains with the drill string after deployment of the seal rotating system. In other words, the running tool serves as part of the drill string. This approach saves substantial time by avoiding retrieval of the running tool prior to conducting the drilling operation.

When used in deepwater operations, for example, a traditional running tool may take up to 24 hours to deploy. By using the alignment mechanism described herein (particularly when the running tool is used as part of the drill string to avoid separate retrieval of the running tool), the deployment time is substantially reduced. Consequently, the rig operation time savings translates directly to cost savings.

According to an embodiment, a seal rotating system and a running tool are quickly and easily aligned via an alignment mechanism while the running tool is part of a drill string. The seal rotating system may then be secured to the running tool, and the drill string may be used to convey the seal rotating system to a rotating control device housing. In deepwater applications, the rotating control device housing may be positioned along a riser. The running tool may then be released from the seal rotating system and moved downhole as part of the drill string to enable performance of a borehole drilling operation without removing the running tool from the drill string.

Figure 1:
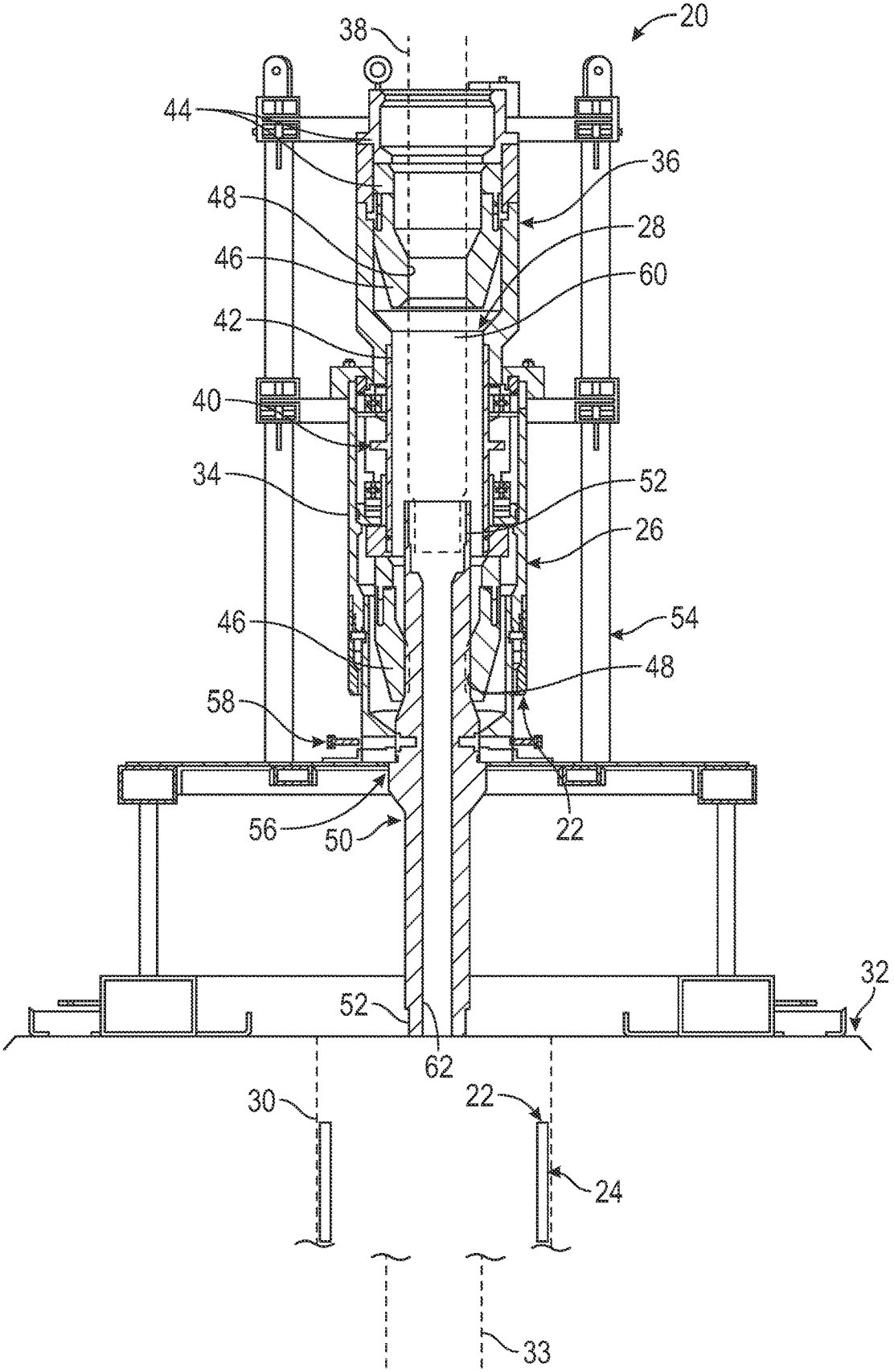
FIG. 1 is a cross-sectional illustration of an example of a running tool positioned within a seal rotating system of a rotating control device, according to an embodiment of the disclosure.

Referring generally to FIG. 1, a system 20 for containing and isolating pressure in a borehole annulus, e.g. a wellbore annulus, is illustrated. System 20 may be used, for example, during a rotary drilling operation. In this embodiment, the system 20 comprises a rotating control device 22 having a rotating control device housing 24 and a seal rotating system 26 sized for receipt in the rotating control device housing 24. The seal rotating system 26 includes an internal longitudinal passage 28 which enables the transfer of equipment, e.g. drill string equipment, therethrough. In a variety of subsea applications or other deepwater applications, the rotating control device housing 24 may be positioned along a riser 30 extending between, for example, a seabed location and a surface facility 32, e.g. a surface rig. However, the rotating control device housing 24 may be positioned along other types of equipment for use in other types of drilling applications used to drill a borehole 33.

In the illustrated example, the seal rotating system 26 is constructed for movement down into the rotating control device housing 24 where it is held in a desired position via suitable fastening mechanisms. In some embodiments, the suitable fastening mechanisms may be remotely controllable from a surface location. For example, the fastening mechanisms may be hydraulically or electrically controlled and may comprise pistons, threaded members, or other suitable mechanisms which may be moved into engagement with the seal rotating system 26 so as to secure the seal rotating system 26 at the desired location within housing 24.

As illustrated, the seal rotating system 26 may comprise a stationary housing structure 34 which is constructed so that it may be secured within the rotating control device housing 24 via the suitable fastening mechanisms. The seal rotating system 26 also comprises a dynamic or rotating portion 36 which is allowed to rotate with, for example, a drill string 38 via a bearing assembly 40. The bearing assembly 40 is mounted between the stationary housing structure 34 and a dynamic housing structure 42 of dynamic portion 36. The dynamic housing structure 42 is able to freely rotate with respect to the stationary structure 34 via bearing assembly 40.

The dynamic housing structure 42 may be constructed in a variety of configurations with a variety of features and components. For example, the dynamic housing structure 42 may comprise suitable types of couplers 44 by which at least one seal 46, e.g. an elastomeric seal, is connected to the dynamic housing structure 42. In the embodiment illustrated, a plurality of seals 46, e.g. two elastomeric seals 46, may be used and positioned, for example, above and below bearing assembly 40. Each of the seals 46 is constructed with an opening 48 sized to receive the drill string 38 therethrough while remaining in sealing engagement with the drill string 38. The bearing assembly 40 allows the seals 46 and the dynamic housing structure 42 to rotate with the drill string 38.

The seal rotating system 26 may be deployed and lowered into the rotating control device housing 24 via a running tool 50. The running tool 50 comprises connection ends 52 which allow the running tool 50 to be coupled into drill string 38 and to become a part of drill string 38. For example, the connection ends 52 may be in the form of box and pin connection ends such as those used to connect joints of drill pipe when assembling various types of drill strings 38.

As the drill string 38 is made up on, for example, the rig/surface facility 32, the seal rotating system 26 may initially be mounted on a removable stand 54 or other suitable structure. The stand/structure 54 may be configured for relatively easy removal and/or to provide openings allowing the seal rotating system 26 and drill string 38 to pass through when the seal rotating system 26 is moved down to the rotating control device housing 24.

Prior to running the seal rotating system 26 down to rotating control device housing 24, the seal rotating system 26 is releasably connected to running tool 50. To facilitate the releasable connection, an alignment mechanism 56 is used to rotationally align the running tool 50 with the seal rotating system 26. Once rotationally aligned at a desired alignment position, a fastening system 58 may be used to temporarily secure the seal rotating system 26 to the running tool 50. In some embodiments, the alignment mechanism 56 also may be used to properly linearly position the seal rotating system 26 with respect to the running tool 50.

According to an operational example, the running tool 50 is moved into longitudinal passage 28 within seal rotating system 26 and connected to a next adjacent drill pipe joint 60 of drill string 38. For example, the running tool 50 may be inserted into longitudinal passage 28 from the bottom of passage 28 for connection with drill pipe joint 60. The drill string 38, with running tool 50, may then be moved linearly, e.g. lifted, so as to cause actuation of alignment mechanism 56. As explained in greater detail below, the alignment mechanism 56 responds to this linear movement to cause relative rotation between the running tool 50 and the seal rotating system 26 to achieve the desired rotational alignment position. In the illustrated example, the alignment mechanism 56 also automatically aligns the running tool 50 and the seal rotating system 26 in a linear direction. Once aligned, the fastening system 58 may be used to temporarily secure the seal rotating system 26 to the running tool 50.

At this stage, the seal rotating system 26 may be released from stand 54. Subsequently, additional drill pipe joints 60 may be connected into drill string 38 as the running tool 50 and attached seal rotating system 26 are moved downwardly. It should be noted the illustrated running tool 50 has an internal passageway 62 through which fluid may be flowed. For example, drilling mud may be flowed down through the drill string 38 and thus through passageway 62. The mud flow returns may be routed through, for example, a side outlet located below the rotating control device housing 24.

Figure 2:
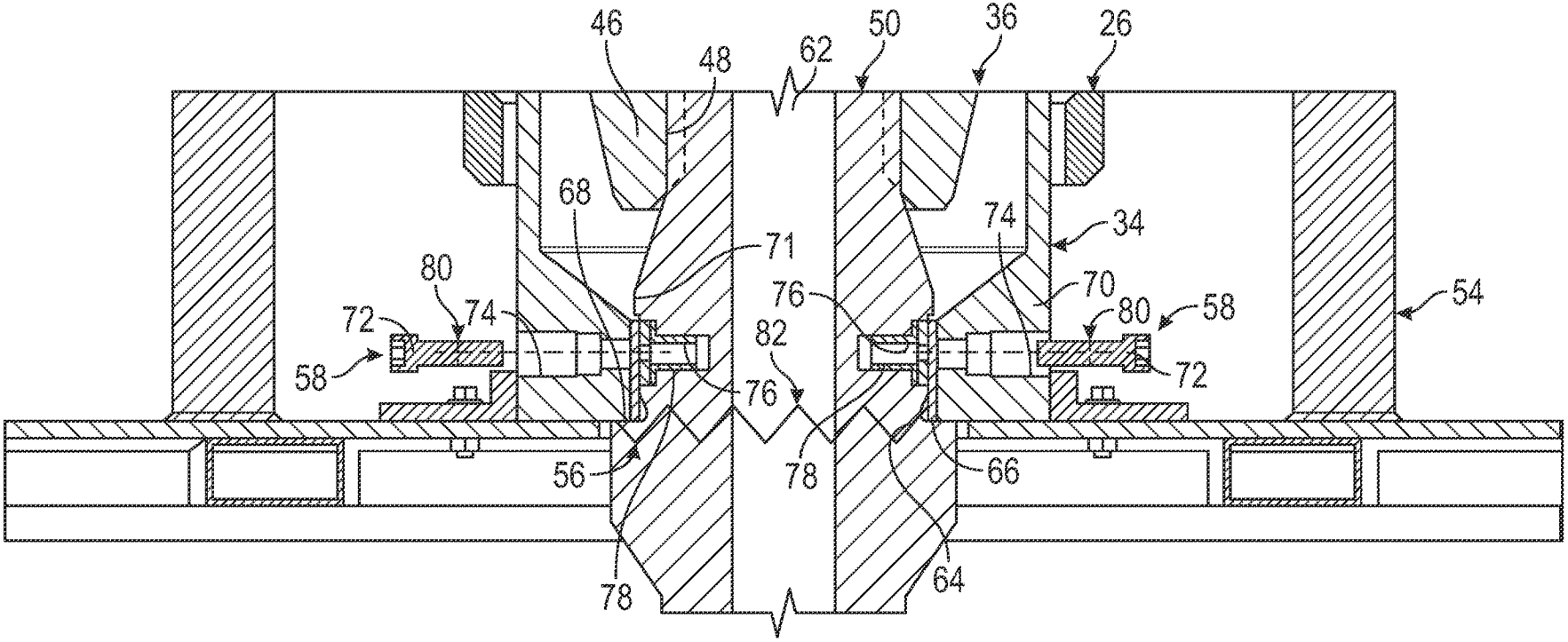
FIG. 2 is a cross-sectional view of the running tool properly aligned with the seal rotating system via one embodiment of an alignment mechanism, according to an embodiment of the disclosure.

With additional reference to FIG. 2, an embodiment of alignment mechanism 56 comprises running tool alignment features 64 which cooperate with seal rotating system alignment features 66 to cause the relative rotation between running tool 50 and seal rotating system 26. By way of example, the running tool features 64 may be located on or adjacent a shoulder 68 of running tool 50. The shoulder 68 may be located so as to limit relative linear motion of the running tool 50 and the seal rotating system 26 at a desired linear position facilitating use of fastening system 58. In the embodiment illustrated, the running tool alignment features 64 extend from shoulder 68 to enable simultaneous performance of the rotational and linear positioning.

In the embodiment illustrated, the seal rotating system alignment features 66 may be located on stationary housing structure 34 which may comprise a mounting portion 70. The mounting portion 70 has an opening 71 sized to slide along the running tool 50 as the running tool 50 is moved linearly via drill string 38 and as running tool alignment features 64 engage seal rotating system alignment features 66 to effectively cause the automatic actuation of alignment mechanism 56. This relative linear movement continues until the alignment features 66 of mounting portion 70 are fully engaged with running tool alignment features 64 and further relative linear movement is restricted by shoulder 68 (see FIG. 2).

The alignment mechanism 56 effectively uses this relative linear movement to cause relative rotation between running tool 50 and seal rotating system 26 to the desired alignment position for connection of fastening mechanism 58. Fastening mechanism 58 may comprise various types of threaded fasteners, pins, clamps, and other suitable fasteners for temporarily securing the running tool 50 and seal rotating system 26. By way of example, the fastening mechanism 58 may comprise threaded fasteners 72.

In this embodiment, once alignment mechanism 56 is used to properly align the running tool 50 and seal rotating system 26, the threaded fasteners 72 may be inserted through corresponding passages 74 of seal rotating system 26 for receipt in threaded openings 76 formed in running tool 50. By way of example, the corresponding passages 74 may be formed through stationary housing structure 34, e.g. laterally through mounting portion 70. The threaded openings 76 may be formed directly in a wall of the running tool 50 or in suitable threaded nut mechanisms 78, as illustrated.

Alignment mechanism 56 ensures that threaded openings 76 and corresponding passages 74 are automatically aligned in a manner which enables easy insertion of threaded fasteners 72. It should be noted a single threaded fastener 72 may be used, but various embodiments use a plurality of the threaded fasteners 72, e.g., four or more. A corresponding number of passages 74 and openings 76 accommodate the threaded fasteners 72.

Furthermore, the threaded fasteners 72 may be formed as shear bolts to enable selective release of running tool 50 from seal rotating system 26. This allows the running tool 50 to be moved downhole as part of drill string 38 when performing a desired drilling operation, e.g. a wellbore drilling operation, after seal rotating system 26 is secured in rotating control device housing 24. The shear bolts 72 effectively form a release system 80 which readily enables controlled release of the running tool 50 and overall drill string 38 from the rotating control device 22. It should be noted the release system 80 may comprise a variety of shear members or other types of release mechanisms which are part of, or work in cooperation with, fastening mechanism 58.

Figure 5:
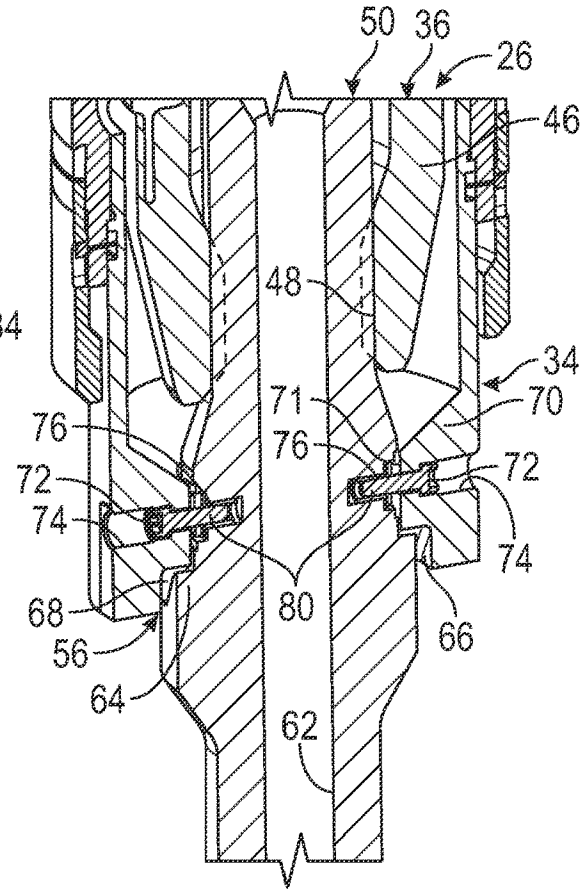
FIG. 5 is a cross-sectional view of a portion of the running tool disposed within the seal rotating system at a desired alignment position, according to an embodiment of the disclosure.
Figure 4:
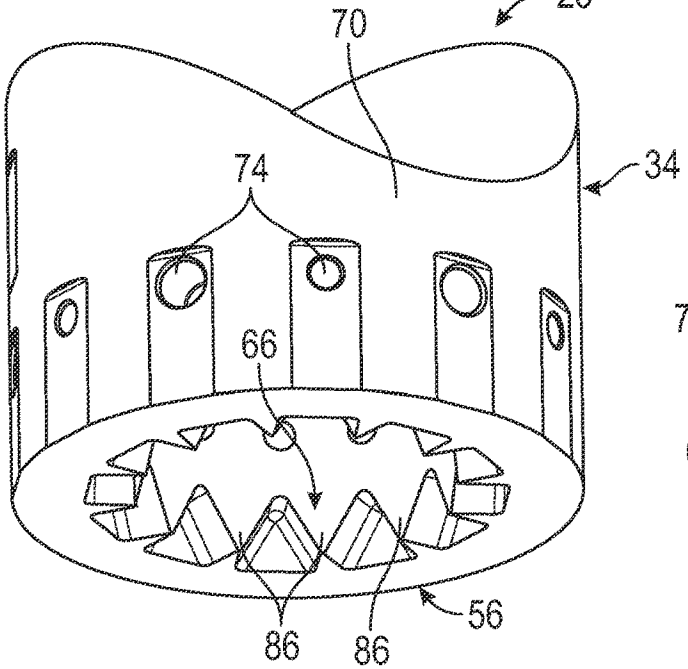
FIG. 4 is an orthogonal view of a portion of the seal rotating system having corresponding alignment features which also serve as part of the alignment mechanism illustrated in FIG. 2, according to an embodiment of the disclosure.
Figure 3:
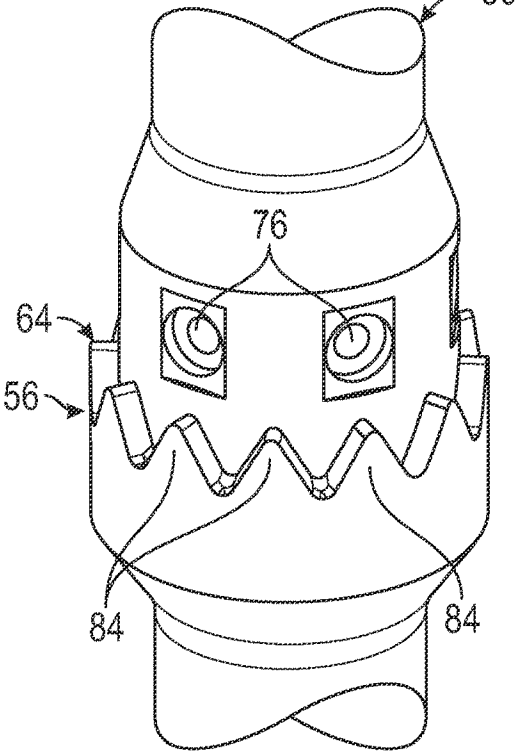
FIG. 3 is an orthogonal view of a portion of the running tool which has alignment features serving as part of the alignment mechanism illustrated in FIG. 2, according to an embodiment of the disclosure.

Referring generally to FIGS. 3-5, an embodiment of alignment mechanism 56 is illustrated. In this example, the alignment mechanism 56 utilizes a sawtooth interface 82 (which is illustrated in FIG. 2). The sawtooth interface 82 may be achieved by forming the running tool alignment features 64 as sloped teeth 84, e.g. generally triangular teeth, as illustrated in FIG. 3. The sloped teeth 84 are oriented to engage the seal rotating system alignment features 66 which may be formed as corresponding sloped teeth 86, e.g. generally triangular teeth, as illustrated in FIG. 4.

Once the running tool 50 is connected into drill string 38, the drill string 38 may simply be moved linearly, e.g. lifted, to engage the running tool alignment features 64 with the seal rotating system alignment features 66. The alignment features 64 and 66 cause relative rotation of the running tool 50 and the seal rotating system 26 due to this linear motion until the desired rotational alignment position is reached. In the illustrated example, the alignment features 64 and 66 are further designed to stop the linear motion at a desired linear alignment position. Effectively, relative linear motion and relative rotational motion are stopped at the desired alignment position so that threaded fasteners 72 may be inserted through corresponding passages 74 of seal rotating system 26 and then threaded into the threaded openings 76 of running tool 50, as illustrated in FIG. 5.

Figure 6:
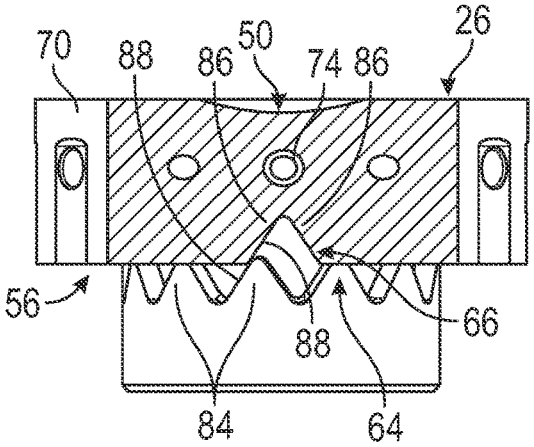
FIG. 6 is an illustration showing how linear movement of the drill string causes the running tool to move the alignment features into engagement with the corresponding alignment features of the seal rotating system, according to an embodiment of the disclosure.
Figure 7:
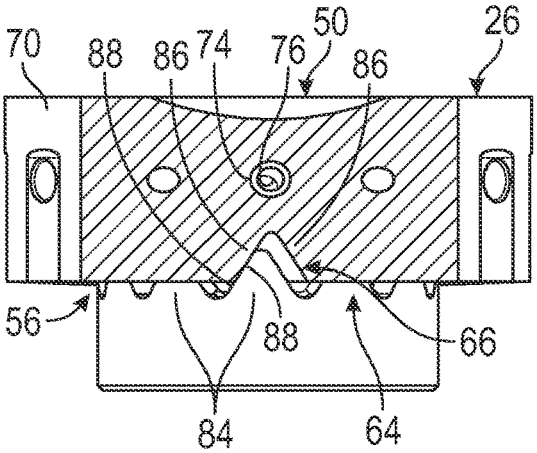
FIG. 7 is an illustration showing how continued linear movement of the drill string enables the alignment mechanism to cause relative rotational movement between the running tool and the seal rotating system, according to an embodiment of the disclosure.
Figure 8:
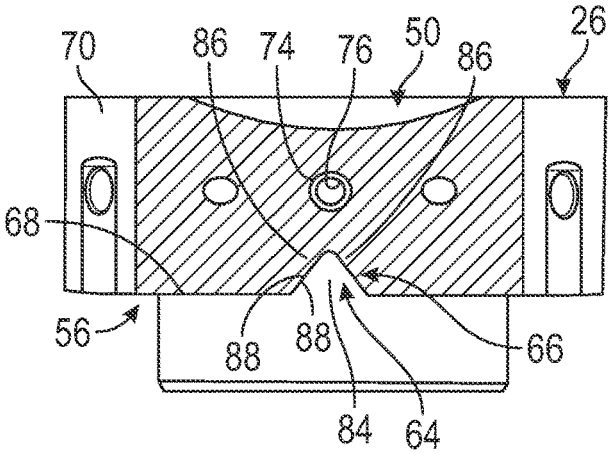
FIG. 8 is an illustration showing how the continued linear movement of the drill string enables the alignment mechanism to ultimately rotationally and linearly align the running tool and the seal rotating system so that threaded fasteners or other fastening mechanism may be used to secure the seal rotating system to the running tool, according to an embodiment of the disclosure.

When the alignment features 64, 66 are in the form of sloped teeth 84, 86, respectively, the automatic relative rotational movement of the running tool 50 with respect to the seal rotating system 26 occurs due to sliding engagement of the sloped teeth 84, 86, as illustrated in FIGS. 6-8. The number, size, configuration, and arrangement of teeth 84, 86 may vary according to parameters of specific operations and/or environments.

By using a plurality of teeth 84 which engage with a plurality of teeth 86, the running tool 50 may be moved into seal rotating system 26 with no restrictions or with minimal restrictions on its initial rotational orientation. The teeth 84 simply engage the teeth 86 at a variety of initial rotational orientations (see FIG. 6). Once the teeth 84, 86 are engaged, continued relative linear motion causes corresponding sloped surfaces 88 of teeth 84, 86 to engage and to force the desired relative rotation (see FIG. 7).

This automatic relative rotation continues until further linear motion is blocked via shoulder 68, as illustrated in FIG. 8. It should be noted that in embodiments with teeth 84, 86, the shoulder 68 is effectively provided by the bottoming out of teeth 84, 86 upon completion of the rotational alignment. Basically, the surfaces of running tool teeth 84 serve as the shoulder 68 against which further linear motion is blocked as the seal rotating system teeth 86 bottom out against the running tool teeth 84. The corresponding passages 74 and threaded openings 76 are positioned relative to the arrangement of teeth 84, 86 such that corresponding passages 74 are fully aligned with threaded openings 76 once the position illustrated in FIG. 8 is reached.

Figure 9:
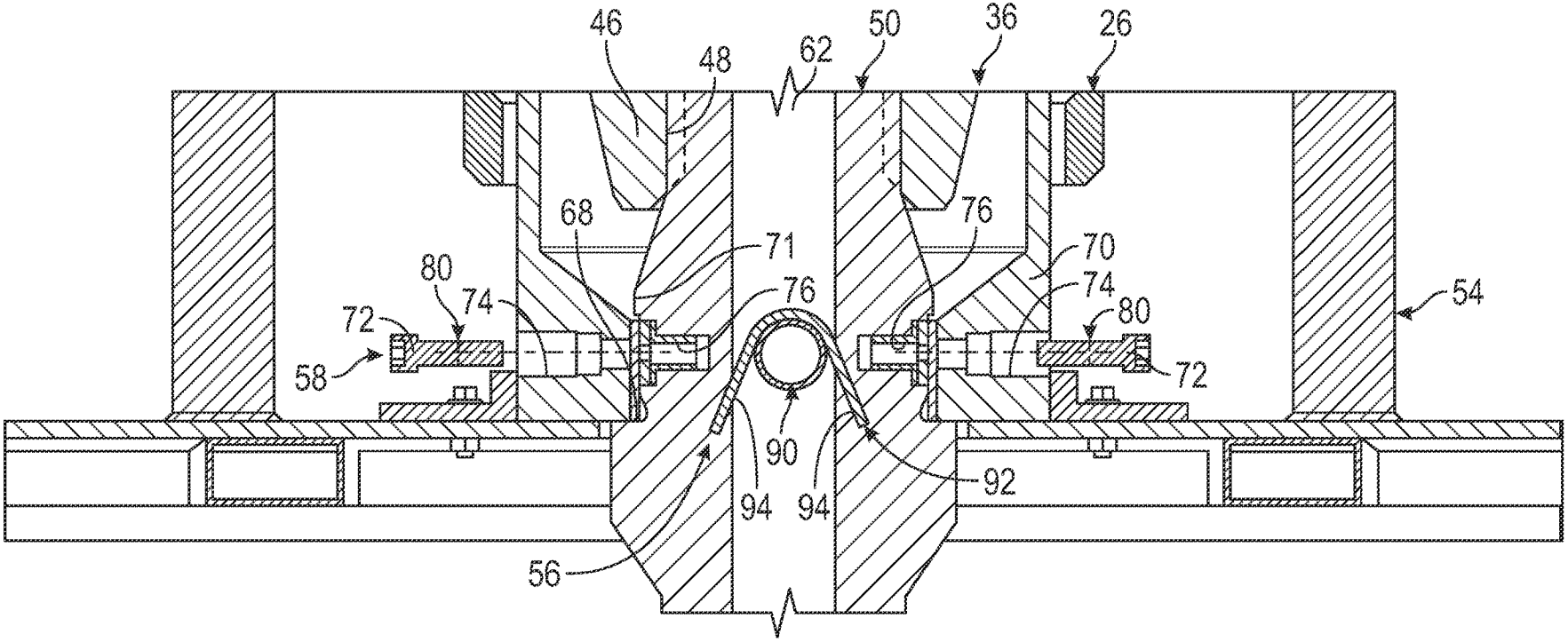
FIG. 9 is a cross-sectional view of the running tool properly aligned with the seal rotating system via another example of an alignment mechanism, according to an embodiment of the disclosure.

It should be noted that alignment mechanism 56 may be constructed with various types of alignment features 64, 66. In FIG. 9, for example, another embodiment of alignment mechanism 56 is illustrated. In this embodiment, the alignment mechanism 56 comprises a protrusion 90, e.g. a plurality of protrusions 90, positioned to enter a wedge-shaped slot 92, e.g. a plurality of corresponding wedge-shaped slots 92.

The sloped sides 94 of the wedge-shaped slot 92 guide the protrusion 90 during linear movement of the running tool 50 relative to the seal rotating system 26 so as to automatically cause relative rotation and alignment of the running tool 50 and seal rotating system 26. By way of example, the at least one protrusion 90 may be in the form of a pin located on the running tool 50. In this configuration, the at least one wedge-shaped slot 92 may be located on mounting portion 70 of seal rotating system 26.

When a drilling operation is to be performed, alignment mechanism 56 facilitates the rapid alignment and temporary connection of seal rotating system 26 to running tool 50. After forming the temporary connection, the seal rotating system 26 may be released and moved down into riser 30 for connection with rotating control device housing 24. Once seal rotating system 26 is secured in housing 24, the fasteners 72 may be sheared to release the running tool 50. The running tool 50 is then moved downhole as part of drill string 38 to perform a desired drilling operation, e.g. a wellbore drilling operation.

When the desired drilling operation is completed or otherwise interrupted, the drill string 38 may be pulled to the surface. As the running tool 50 is moved upwardly with the drill string 38, the shoulder 68 once again engages the seal rotating system 26 as it moves through the rotating control device housing 24. Fastening mechanisms of rotating control device housing 24 may be released to allow the seal rotating system 26 to be lifted from the rotating control device housing 24. In this manner, the seal rotating system 26 is automatically lifted to the surface with the running tool 50 as the drill string 38 is retrieved.

Depending on the specific well operation and well equipment, the overall system 20 may be adjusted and various additional or alternate components may be utilized. For example, the features, size, and shape of the seal rotating system 26 and running tool 50 may be adjusted. The alignment mechanism 56 may comprise various types of alignment features 64, 66 to facilitate the automatic rotational alignment of the seal rotating system 26 and the running tool 50. In various embodiments, the alignment features may be part of, or used in conjunction with, a shoulder or other feature to further enable automatic linear alignment. Additionally, the components may be constructed for use in a variety of subsea applications and also other types of drilling applications.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method to facilitate drilling a borehole, comprising:

positioning a running tool in a seal rotating system;

connecting the running tool into a drill string;

moving the running tool linearly via the drill string to engage mating teeth of an alignment mechanism which, in turn, automatically rotationally aligns the running tool within the seal rotating system during the linear movement, wherein the mating teeth of the alignment mechanism comprise upward facing teeth on an outer circumference of the running tool and downward facing teeth on an inner circumference of a stationary housing of the seal rotating system, a radial thickness of the upward facing teeth is less than a total radial thickness of the running tool, and a radial thickness of the downward facing teeth is less than a total radial thickness of the stationary housing; and securing the running tool to the seal rotating system while rotationally aligned.

2. The method as recited in claim 1, wherein moving comprises using the alignment mechanism to cause relative rotation between the running tool and the seal rotating system via a sawtooth interface between the upward facing teeth and the downward facing teeth.

3. The method as recited in claim 1, wherein the upward facing teeth comprise upward sloped teeth, and the downward facing teeth comprise downward sloped teeth.

4. The method as recited in claim 1, further comprising deploying the secured seal rotating system and running tool into a subsea riser via the drill string.

5. The method as recited in claim 4, further comprising releasing the running tool from the seal rotating system and moving the running tool and the drill string down through the seal rotating system to enable a subsea drilling operation.

6. The method as recited in claim 5, wherein securing comprises securing the running tool and the seal rotating system together via a plurality of threaded fasteners.

7. The method as recited in claim 6, wherein releasing comprises shearing the plurality of threaded fasteners.

8. The method as recited in claim 1, wherein the alignment mechanism is configured to cause both axial and circumferential alignment of one or more fastener features, wherein the one or more fastener features comprise one or more first fastener receptacles extending completely through the stationary housing of the seal rotating system and one or more second fastener receptacles extending only partially through the running tool.

9. A system, comprising:

a seal rotating system of a rotating control device;

a running tool sized for receipt within the seal rotating system;

an alignment mechanism having mating teeth on the seal rotating system and on the running tool which automatically cause relative rotation between the running tool and the seal rotating system to achieve a desired alignment position as the running tool is moved linearly within the seal rotating system, wherein the mating teeth of the alignment mechanism comprise upward facing teeth on an outer circumference of the running tool and downward facing teeth on an inner circumference of a stationary housing of the seal rotating system, a radial thickness of the upward facing teeth is less than a total radial thickness of the running tool, and a radial thickness of the downward facing teeth is less than a total radial thickness of the stationary housing; and a fastening system to temporarily secure the running tool and the seal rotating system at the desired alignment position.

10. The system as recited in claim 9, wherein the running tool is coupled into a drill string.

11. The system as recited in claim 10, wherein the rotating control device further comprises a rotating control device housing for receiving the seal rotating system, and wherein the rotating control device housing is positioned along a subsea riser.

12. The system as recited in claim 9, wherein the upward facing teeth comprise upward sloped teeth, and the downward facing teeth comprise downward sloped teeth.

13. The system as recited in claim 9, wherein the fastening system comprises a plurality of threaded fasteners extending through a first plurality of radial fastener receptacles extending completely through the stationary housing of the seal rotating system and into a second plurality of radial fastener receptacles extending only partially through the running tool, wherein the alignment mechanism is configured to cause both axial and circumferential alignment of the first plurality of radial fastener receptacles with the second plurality of radial fastener receptacles.

14. The system as recited in claim 13, wherein the plurality of threaded fasteners are shearable to enable selective release of the running tool from the seal rotating system.

15. The system as recited in claim 9, wherein the seal rotating system comprises:

a rotating portion configured to rotate relative to the stationary housing;

a bearing assembly disposed between the rotating portion and the stationary housing;

a first seal above the bearing assembly; and a second seal below the bearing assembly.

16. A system, comprising:

an alignment mechanism for use in a well operation, the alignment mechanism having mating teeth which automatically cause relative rotation of a running tool as the running tool is moved linearly within a seal rotating system of a rotating control device, the mating teeth being arranged to force the running tool to a desired rotational position and a desired linear position with respect to the seal rotating system to enable temporary attachment of the running tool to the seal rotating system via a fastener mechanism, wherein the mating teeth of the alignment mechanism comprise upward facing teeth on an outer circumference of the running tool and downward facing teeth on an inner circumference of a stationary housing of the seal rotating system, a radial thickness of the upward facing teeth is less than a total radial thickness of the running tool, and a radial thickness of the downward facing teeth is less than a total radial thickness of the stationary housing.

17. The system as recited in claim 16, wherein the running tool is coupled into a drill string for use during a borehole drilling operation.

18. The system as recited in claim 16, wherein the alignment mechanism utilizes a sawtooth interface between the upward facing teeth and the downward facing teeth, the upward facing teeth comprise upward sloped teeth, and the downward facing teeth comprise downward sloped teeth.

19. The system as recited in claim 16, wherein the alignment mechanism is configured to cause both axial and circumferential alignment of a plurality of fastener features, wherein the plurality of fastener features comprise a plurality of first radial fastener receptacles extending completely through the stationary housing of the seal rotating system and a plurality of second radial fastener receptacles extending only partially through the running tool.

20. The system as recited in claim 16, wherein the downward facing teeth extend to a flat annular bottom surface of the stationary housing of the seal rotating system.

* * * * *